United States Patent [19]

Kauffman et al.

[11] Patent Number: 4,950,500

[45] Date of Patent: Aug. 21, 1990

[54] METHOD FOR MAKING A DECORATIVE LAMINATE

[75] Inventors: William J. Kauffman, Lititz; Timothy D. Colyer, Columbia; Martin Dees, Jr., Landisville, all of Pa.

[73] Assignee: Armstrong World Industries, Inc., Lancaster, Pa.

[21] Appl. No.: 664,424

[22] Filed: Oct. 24, 1984

[51] Int. Cl.[5] ..... B05D 5/06; B05D 1/12; B05D 3/02

[52] U.S. Cl. ..... 427/197; 427/203; 427/373

[58] Field of Search ..... 427/197, 203, 205, 199, 427/244, 204

[56] References Cited

U.S. PATENT DOCUMENTS 4,357,189 11/1982 Buckwalter et al. ..... 156/230
4,599,264 7/1986 Kauffman ..... 428/264

*Primary Examiner*—Evan Lawrence

[57] ABSTRACT

A method of manufacture for producing a decorative laminate which exhibits through-color printing is provided in which a layer of absorptive PVC resin particles of substantially only one particle thickness is printed with, for example, three differently colored vinyl plastisol printing inks. The decorative article is useful as a floor covering.

10 Claims, 2 Drawing Sheets

METHOD FOR MAKING A DECORATIVE LAMINATE

FIELD OF THE INVENTION

The present invention relates to decorative laminates that are suitable as surface coverings for floors, walls, etc., and, more particularly, is directed to a method for making a decorative laminate having a printed layer of absorptive polyvinyl chloride particles.

BACKGROUND OF THE INVENTION

Generally speaking, decorative laminates useful as surface coverings for floors are well-known in the art and have achieved broad use in both domestic and commercial environments. For example, decorative laminates in the form of sheet material of a resinous polymer composition, e.g., polyvinyl chloride, on a suitable substrate, e.g., a fibrous backing sheet, have been used for many years as sheet flooring. A goal common to all manufacturers of sheet flooring is to provide flooring products having appealing surface decorative effects that are both attractive from an aesthetic viewpoint and useful from a functional standpoint. To illustrate, many methods and processes such as mechanical embossing, chemical embossing or inlaying have been utilized to provide contrasting surface finishes and thereby impart decorative effects to the sheet flooring. For example, U.S. Pat. Nos. 3,000,754; 3,121,642 and 4,298,646 each discloses different techniques or means for making floor covering products such as floor tiles or sheet flooring having decorative surface effects. Recently issued U.S. Pat. No. 4,450,194 discloses a decorative laminate having both differential surface texture and differential gloss achieved by using a specific class of absorptive polyvinyl chloride (PVC) resin particles that are disposed in register on selected portions of a printed design on a substrate or base layer of the laminate.

SUMMARY OF THE INVENTION

According to the present invention there is provided a decorative laminate suitable as a floor covering comprising a substrate having a printed layer of absorptive PVC resin particles adhered to said substrate or to a foamed layer of a PVC resin adhered directly to said substrate and, optionally, a layer of transparent synthetic organic polymer adhered to the surface of said printed layer of absorptive PVC resin particles.

According to the present invention there is further provided a method for making a decorative laminate suitable as a floor covering, said method comprising applying to a substrate material a vinyl plastisol adhesive composition; applying an excess of absorptive PVC resin particles over said vinyl plastisol adhesive composition and removing the excess of said absorptive PVC resin particles that do not adhere to said vinyl plastisol adhesive composition; heating said substrate to gel said vinyl plastisol adhesive composition thereon and thereby firmly adhere said absorptive PVC resin particles to said vinyl plastisol adhesive composition; applying at least one PVC plastisol printing ink composition to said absorptive PVC resin particles, and heating said substrate to gel said PVC plastisol printing ink composition; and, optionally, forming a top resinous layer on said printed, absorptive PVC resin particles by applying a transparent synthetic organic polymer over said printed, absorptive PVC resin particles, followed by heating the resulting intermediate laminate of resinous layers thereby to provide a fused decorative laminate.

DETAILED DESCRIPTION OF THE INVENTION

Figure 1A:
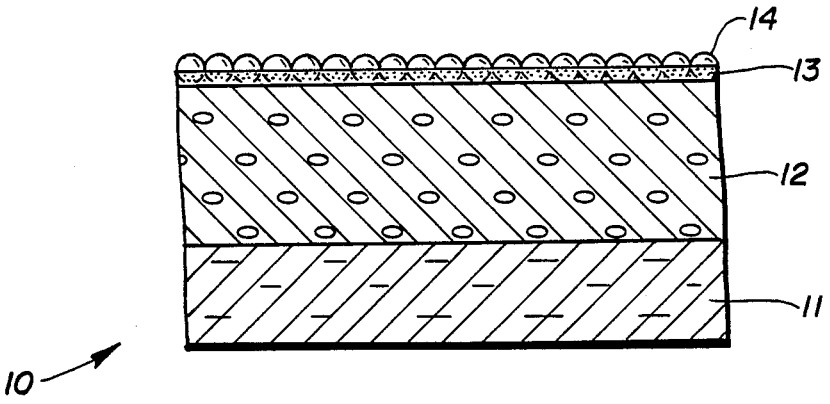
FIGS. 1A and 1B are cross-sectional views depicting the arrangement of elements and structural features of a decorative laminate of the invention having absorptive PVC resin particles in the top or uppermost layer thereof.

Referring to FIGS. 1 and 2, which disclose preferred embodiments, the decorative laminate 10 of the invention comprises a substrate member 11 which is often referred to as a base layer or backing sheet. The substrate member or element 11 bears a layer 12 of foamed PVC resin disposed preferably over the entire surface of substrate 11. A layer 13 of PVC resin adhesive is disposed over the entire surface of foamed PVC layer 12. Particles of printed polyvinyl chloride (PVC) 14 are disposed on and secured to the layer 13 of vinyl plastisol adhesive. A top layer 15 of transparent synthetic organic polymeric material overlies the printed PVC resin particles 14. Layer 15 of laminate 10 is often referred to as a "wear layer" when the laminate is used as a floor covering. The decorative laminate of the invention as shown in FIGS. 1 and 2 is of unitary construction wherein the elements or components thereof described hereinabove have been fused by heat into a single structure in accordance with the method described hereinafter.

The decorative laminate 10 depicted in FIG. 2 and which includes a layer 15 of transparent synthetic organic polymeric material represents a preferred embodiment especially in instances wherein foamable PVC plastisol printing inks are applied to the absorptive PVC resin particles of laminate 10. In such construction, the overall clear coat or layer 15 protects the foamed PVC plastisol ink material. In the embodiment of FIG. 1, nonfoamable PVC plastisol inks have been applied to the absorptive PVC particles 14, followed by heating to fuse the printed PVC particles to provide a suitable wear layer.

Figure 3:
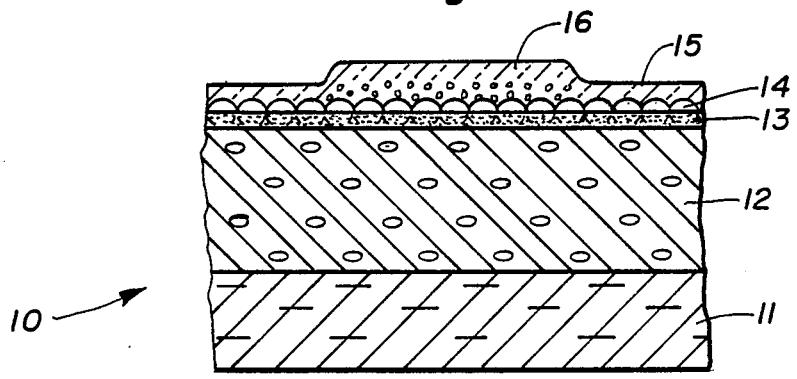
FIG. 3 is a cross-sectional view of another embodiment of the decorative laminate of the invention having a foamed or raised section in the top layer which provides an embossed surface.

The decorative laminate 10 depicted in FIG. 3 includes a foamed or expanded section 16 in selected areas of the top surface so as to present a differential surface effect, i.e., embossment, which in combination with selected printing inks in the absorptive PVC resin particles can provide a wide variety of desired visual effects.

The elements of decorative laminates 10 will be described individually herebelow in conjunction with a description of the method for combining these elements to make the decorative laminates.

The Substrate

The decorative laminate 10 is formed on a substrate or backing sheet 11 of strong, durable and flexible material. The flexible backing can be woven, felted or a solid sheet of synthetic or natural material. The conventional flexible backing is a web of felted fibers. The felt generally is produced using a Fourdrinier or cylinder paper machine with the thickness of the resulting sheet being that usually used in floor and wall covering, that is, from 0.02 to 0.08 inch. A thickness of about 0.032 inch is usually preferred. The fibrous material used is normally cellulose or asbestos in origin, although other fibers can be used including those of mineral and animal origin. The sources of cellulosic material can include cotton or other rag material, wood pulp including both ground wood and chemical wood pulp, paper, boxes, or mixtures thereof in any proportion. The web can also contain fillers, such as wood flour.

The felt can be strengthened and improved in water resistance by impregnation with a bituminous material. Numerous bituminous materials are well-known as impregnants in the production of printed surface coverings and include asphalts of petroleum or natural origin and tars and pitch residues of animal or vegetable origin. These materials can be treated to attain the desired physical properties of softening point or viscosity for satisfactory use by such treatment as air blowing, steam distillation and the like.

The impregnant should be uniformly dispersed throughout the felt sheet. This can be controlled to some extent by the saturating technique through use of pressure rolls in the saturating bath. Where the impregnant is not uniformly dispersed throughout, blistering can frequently occur due to high concentrations of material adjacent to one surface of the felt.

Other impregnants for the fibrous sheet can also be used to form backing sheets for use in the production of printed surface coverings in accordance with the invention. Such materials as phenolformaldehyde and phenol-urea resins, polymerized vinyl compounds, such as polyvinyl chloride, polyvinyl acetate and the like, cellulose acetate, cellulose nitrate, butadiene-styrene copolymer, butadiene acrylonitrile copolymer, natural rubber and the like can be used. Polymerizable materials can also be incorporated into the felt and the sheet subjected to heat to cure and polymerize the material. Such materials as natural and synthetic drying oils, mixtures of polyhydric alcohols and polybasic acids which cure to form polyesters, mixtures of polyhydric alcohols and polyisocyanates which cure to form urethane polymers, and the like can be used.

If an impregnated backing sheet is used, it usually is provided with one or more seal coats prior to printing any desired decorative design thereon. The seal coats perform the desirable function of masking the color of the felt and preventing the impregnant from bleeding through and staining the wear layer and, in addition, create a smooth uniform surface suitable as a base for printing. Felt sheets of the type commonly used as backings for printed surface coverings tend to have minor surface irregularities due to non-uniformities in the felt-making equipment. The sheet also frequently shows a number of small protruding lengths of fibers. The seal coats are designed to hide all these irregularities. The total thickness of seal coats required is normally from about 1 to about 12 mils. This thickness can be created through use of a single thick coating or several superimposed thinner coatings. Using the conventional techniques of coating, such as flexible doctor roller application, the desired thickness is created by use of more than one coating. The use of multiple coatings is also desirable in promoting optimum adhesion of the wear surface layer to the backing, since the seal coat applied directly to the fibrous backing can be designed for optimum sealing against migration of bituminous impregnant and the uppermost seal coat can be designed for optimum adhesion to the polyvinyl chloride surface wear layer.

The seal coat is conveniently applied in the form of an aqueous emulsion of resinous binder and filler. In the preparation of the seal coat, a resinous binder and filler are emulsified in water in the presence of conventional wetting agents, thickening agents, anti-foam agents, sequestering agents and the like. After the application of the seal coat to the backing sheet, the coating is dried by subjecting the sheet to heat, as for example, in the range of about 100° F. to about 150° F. for about 30 minutes to about 2 hours. Alternately, drying can be effected by exposing the coated sheet to a temperature of 350° F. to 400° F. for about 30 to about 300 seconds.

The resinous compound of the seal coat is preferably a vinyl resin. Suitable resins are commercially available in the form of aqueous dispersions containing from 40 to 50 percent solids, and vinyl resin plastisols and organosols. The dispersion can contain, in addition to the plasticizer, resin, pigment and filler, conventional wetting agents, thickening agents, anti-foam agents, sequestering agents and alkali. Suitable wetting agents include the sodium salt of polymerized alkyl aryl sulfonic acid, potassium oleate, alkyl aryl polyether sulfonate, resin acid soap and the like. Ammonium caseinate, borated casein, methyl cellulose, carboxymethyl cellulose, hydroxyethyl cellulose and the like are satisfactory thickening agents. Examples of suitable anti-foam agents are pine oil and silicone anti-foam agents, diglycol laurate, and octyl alcohol. Suitable sequestering agents include tetrasodium pyrophosphate and the tetrasodium salt of ethylenediamine tetra-acetic acid. The alkali provides a pH of about 7.0 so that there will be no tendency for the latex to coagulate. Calcium hydroxide, sodium hydroxide, ammonia and potassium hydroxide are suitable alkalis for this purpose.

Normally, the pigments and fillers are ground with water in the presence of wetting agents, thickening agents and the like and the pigment dispersion is mixed with the vinyl resin and plasticizer later. Alternately, the seal coat can be effectively applied in the form of a solution using, for example, a solvent such as toluene or methyl ethyl ketone. However, the cost of using solvent and the fire and health hazards created by its use render the method less desirable.

The seal coat can contain stabilizers to retard the decomposition of the vinyl resin and increase the life of the product, such as sulfides and sulfites of aluminum, silver, calcium, cadmium, barium, sodium, magnesium, strontium; lead and tin stearates; oleates and other complexes; glycerine, leucine, alanine, o- and p-aminobenzoic and sulfanilic acids, hexamethylene tetramine, salts including phosphates, stearates, palmitates, oleates, ricinoleates, abietates, laurates, salicylates; and the like.

As stated hereinabove, the resin component of the seal coat is preferably a vinyl resin, that is, a polymeric material obtained by polymerizing compounds containing at least one $—CH{=}CH_2$ radical. Useful vinyl resins include homopolymers, such as polyvinyl chloride, polyvinyl acetate, polyvinyl propionate, polyvinyl butyrate, polymerized vinylidene chloride, polymerized acrylic acid, polymerized ethyl acrylate, polymerized methyl acrylate, polymerized propyl acrylate, polymerized butyl acrylate, and the like; copolymers of the above with each other such as vinyl chloride-vinyl acetate copolymer, vinylidene chloride-vinyl chloride copolymer, methyl methacrylate-vinyl chloride copolymer, methyl acrylate-ethyl acrylate copolymer, ethyl acrylate-butyl acrylate copolymer, and the like and copolymers of the above with other monomers copolymerizable therewith, such as vinyl esters, including vinyl bromide, vinyl fluoride, vinyl choroacetate, vinyl alkyl sulfonates, trichloroethylene and the like; vinyl ethers such as vinyl ethyl ether, vinyl isopropyl ether, vinyl chloroethyl ether and the like; cyclic unsaturated compounds such as styrene, chlorostyrene, coumarone, vinyl pyridine and the like; maleic and fumaric acid and their derivatives such as diethyl maleate, dibutyl fumarate and the like; unsaturated hydrocarbon such as ethylene, propylene, butylene and the like; allyl compounds such as allyl acetate, allyl chloride, allyl ethyl ether, and the like; conjugated and cross-conjugated unsaturated compounds such as butadiene, isoprene, chloroprene, 2,3-dimethylbutadiene-1,3, divinyl ketone and the like. The monomers listed hereinabove are useful in preparing copolymers with a vinyl resin and can be used as modifiers in the polymerization, in which case they may be present in an amount of a few percent, or they can be used in larger quantities, up to as high as 40 percent by weight of the mixture to be polymerized. If desired, a mixture of vinyl resins can be used in preparing coating paints for use in the invention.

A plasticizer for the vinyl resin is also frequently present in the seal coat composition. Suitable plasticizers for the vinyl resin include ester type plasticizers such as tributyl phosphate, dioctyl phthalate, dipropylene glycol dibenzoate, phenyl phosphate, dibutyl tartrate, amyl tartrate, butyl benzyl benzoate, dibutyl sebacate, dioctyl adipate, didecyl adipate and the like, rubbery plasticizers, such as butadiene-styrene copolymer, butadiene-acrylonitrile copolymer, and the like, and other materials which function as plasticizers, such as epoxidized drying oils, aromatic hydrocarbon condensates and the like. Where certain flexible soft vinyl resins are used in formulating the seal coat, such as polymers containing large proportions of ethyl acrylate, no plasticizer is needed. However, in most instances, a plasticizer is essential in order to impart the necessary properties of flexibility to the dried seal coat film. The seal coat must be compatible with the subsequently applied layer.

Likewise, plastisol or organosol dispersions of vinyl resins can be utilized for seal coats on one or both surfaces of substrate 11.

The thickness of the relatively flat, fibrous substrate 11 will depend to a large extent upon the particular product to be made and the particular subsequent use for which it is intended. Normally, a thickness in the range of from about 10 mils to about 90 mils is satisfactory.

The substrate 11 of FIGS. 1, 2 and 3 may also be a thin sheet or mat of glass fibers that is saturated or completely coated with a heat-cured polyvinyl chloride plastisol or organosol. Glass fiber mats are readily available and are disclosed in, for example, U.S. Pat. Nos. 3,980,511; 4,018,647 and 4,234,379, including also German Patent Publication OS No. 2,605,879, and the many patents that are described in the aforementioned patents.

Alternatively, the decorative laminate 10 can be made on a release carrier instead of a permanent backing sheet 11, so that the decorative laminate can be separated from the release carrier after fabrication to provide a flexible decorative laminate 10 of substantially only vinyl construction.

Foamed Layer

Figure 2A:
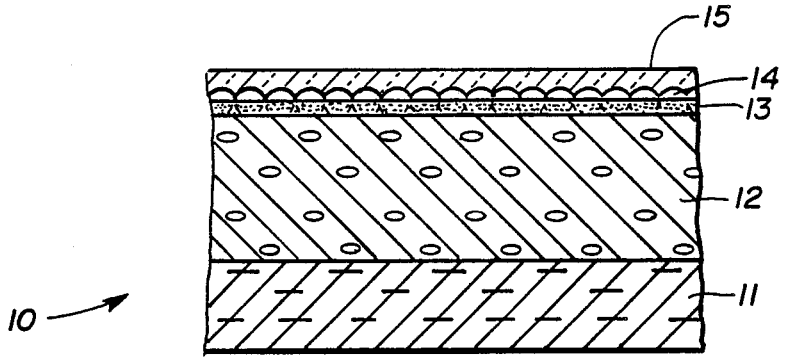
FIGS. 2A and 2B are cross-sectional views of another embodiment of the decorative laminate of the invention having a transparent layer of polymeric material overlying the layer of printed absorptive polyvinyl chloride particles.

As shown in FIGS. 1A, 2A and 3, the decorative laminate 10 includes a layer 12 of foamed resinous polymeric material such as foamed or blown PVC. The foamed layer 12 is between about 10 mils and 80 mils thick and is firmly bonded to substrate 11. The use of foamable thermoplastic resins such as PVC is now conventional in the flooring art and is disclosed in numerous published patents as, for example, U.S. Pat. Nos. 3,962,507 and 3,293,094. Typically, the foamable thermoplastic resin is applied to the backing or support member 11 in the form of a foamable plastisol of PVC utilizing conventional coating equipment such as, for example, reverse roll coater. The foamable PVC plastisol is gelled after being deposited on substrate 11 by heating the plastisol to a temperature of from about 240° F. to about 450° F., preferably between about 290° F. and about 350° F., thereby consolidating and partially coalescing the PVC resin of the plastisol to provide a firm or gelled layer that can be handled and processed during subsequent manufacturing operations. The gelling temperature utilized is not so high as to cause blowing or foaming of the base resinous polymer of the plastisol composition. Subsequently, the gelled layer will be heated to a temperature sufficiently high to foam and fuse simultaneously the PVC resin and thus provide foamed layer 12, in the manner described hereinafter.

Vinyl Plastisol Adhesive Layer

The layer 12 of gelled and foamable PVC is coated with a layer 13 of suitable adhesive composition, preferably of vinyl plastisol, to a thickness of between about 1 and about 4 mils. The adhesive layer 13 of vinyl plastisol is applied to the gelled and foamable PVC layer 12 preferably by means of a rotary screen/blade coating device. The combination of a rotary screen and a blade squeegee permits good application control of the vinyl plastisol adhesive composition. A suitable vinyl plastisol adhesive composition comprises:

| | phr |
|---|---|
| Vinyl chloride dispersion resin (Tenneco 1732) | 100 |
| Primary plasticizer (DOP) | 35 |
| Secondary plasticizer (TXIB) | 17 |
| Epoxy stabilizer (Drapex 4.4) | 3 |
| Tin stabilizer (Mark 275) | 1 |

Application Of PVC Particles To The Vinyl Plastisol Adhesive Layer

Particles 14 of absorptive polyvinyl chloride (PVC) resin are applied to vinyl plastisol adhesive layer 13 preferably by flooding the entire layer 13 with the absorptive PVC resin particles. The PVC resin particles adhere to the adhesive layer 13, and the excess PVC resin particles that overlie the PVC resin particles in contact with adhesive layer 13 are removed by appropriate means, e.g., air knife, vacuum or suction techniques and devices.

The absorptive PVC resin particles utilized for making the decorative laminate of the invention must be characterized by two essential features, namely, particle size and plasticizer absorption properties. Specifically, the PVC resin particles must have a particle size diameter of between about 6 mils and about 20 mils with, preferably, an average particle size diameter of between about 8 and about 12 mils.

Also, the PVC resin particles must be classified as a Type GP resin (as specified in Table 1 of ASTM-D-1755). Preferably, the PVC resin particles are characterized by a plasticizer absorption greater than about 40 grams per 100 grams of PVC resin (as measured by ASTM-D-3367, modified to allow a standing time of 5 minutes instead of the 15 minutes specified in paragraph 7.6 of the ASTM procedure). The specific plasticizer absorption of PVC resin particles can vary depending upon the number of vinyl plastisol printing ink compositions utilized for printing the absorptive PVC particles. For example, a lower plasticizer absorption is sufficient if only one vinyl plastisol printing ink composition is utilized, and a greater plasticizer absorption level or rating is necessary if three vinyl plastisol printing ink compositions are utilized for printing absorptive PVC resin particles. Satisfactory results have been achieved using GP resins having a cell classification number of 4 (ASTM-D-1755).

PVC resin particles having the foregoing particle size and plasticizer absorption properties are necessary in order to obtain the desired printed (through-color) and thin features of the decorative laminate of the present invention. Satisfactory results have been obtained using a particulate PVC resin sold under the tradename designation "Geon 92" by the B. F. Goodrich Chemical Company, Inc., Cleveland, Ohio. Particulate PVC resins that have not provided the desired printed (through-color) and thin features or properties include blending resins such a TENNECO 501 and Goodyear Pliovic M-70, and dispersion PVC resins such as TENNECO 1732 and TENNECO 1755.

The absorptive PVC resin particles can be either clear, i.e. uncolored, or colored. Suitably colored PVC resin particles can be obtained by mixing clear PVC resin particles with dry opaque pigments with a suitable amount of plasticizer. The concentration of opaque pigment utilized should not be so high as to adversely affect the absorption property of the PVC resin particles, since otherwise, the absorption property of the PVC resin particles and the desired print (through-color) and thin features of the ultimate decorative laminate product are not obtained. Use of too large a quantity of plasticizer should be avoided when preparing colored PVC resin particles. Large quantities of plasticizer adversely affect the absorption of subsequently applied printing inks which, in turn, renders more difficult the achievement of desired visual features of the finished, printed laminate product. For example, the quantity of primary plasticizer which can be added to the absorptive PVC resin particles, such as Geon 92 as in Example 1, should be less than about 30 phr.

The substrate 11 having the absorptive PVC resin particles adhered to the vinyl plastisol adhesive layer 13 is heated by conventional means, e.g., in a convection oven or by radiant heaters, to gel the vinyl plastisol adhesive layer and firmly adhere the PVC resin particles thereto. Care must be exercised to avoid overheating the adhesive layer 13 during the gelling sequence, since otherwise the absorptive PVC resin particles will absorb the adhesive vinyl plastisol of layer 13 and not produce the desired absorption of subsequently applied printing inks. A suitable heating range is between about 250° F. and about 450° F., preferably 300° F.

Alternatively, PVC resin particles can be applied directly to foamable PVC plastisol layer 12 before gelling layer 12 without employing vinyl plastisol adhesive layer 13. This procedure does not permit direct printing of the gelled foamable plastisol layer 12 per se, and in this instance the foamable plastisol layer 12 also functions as the adhesive layer for the PVC resin particles. Example 1 herebelow exemplifies this embodiment of the decorative laminate of the present invention.

The Vinyl Plastisol Printing Composition

The layer of absorptive PVC resin particles adhered to layer 13 of gelled vinyl plastisol adhesive is printed or coated with one or more suitable printing ink compositions in any desired pattern or design. The particular pattern or design which is used does not relate to the essence of the invention and any suitable pattern or design may be selected. The printing procedure, in general, is conventional and should require no further description, inasmuch as such procedures are well known in the industry and are described in many publications and patents.

The printing composition is preferably a vinyl plastisol ink which is applied to the layer of absorptive PVC resin particles by means of a rotary screen/blade or roll coating device. The combination of a rotary screen printer and a blade or roller squeegee permits good control of the plastisol ink application.

A salient feature of the present invention is that the specified absorptive PVC resin particles have absorption characteristics that enable application of one or more vinyl plastisol printing ink compositions directly onto the PVC resin particles to achieve any desired printing or visual effect. Surprisingly, the vinyl plastisol printing ink compositions can be applied sequentially without the need to dry the printing inks between the successive applications thereof, in a manner or methodology referred to as wet-on-wet (WOW) printing.

Following application of the desired vinyl plastisol printing inks to the layer of absorptive PVC resins particles, the vinyl printing inks are gelled by heating substrate 11 (e.g., a conventional forced convection oven) to a temperature of between about 240° F. and about 350° F.

The vinyl plastisol printing ink composition utilized for printing the layer of absorptive PVC resin particles may be either foamable or nonfoamable in nature. If a nonfoamable printing ink is used, then, the resulting printed substrate can be fused directly if desired in the manner indicated herebelow without the application of a clear top coat or protective layer. Alternatively, a top coat such as depicted by reference numeral 15 in FIG. 2 can be applied over absorptive PVC resin particles printed with nonfoamable vinyl plastisol printing inks. If, however, a foamable printing ink is used, then a clear top coat of vinyl plastisol is usually applied to the printed absorptive PVC resin particles as depicted by reference numeral 15 in FIG. 3 and described next herebelow.

TOP LAYER OF TRANSPARENT

Synthetic Organic Polymer

The substrate 11 having printed absorptive PVC resin particles positioned thereon and adhered thereto may be coated with a top layer 15 of transparent, synthetic organic polymeric material such as, for example, a polyvinyl chloride (PVC) plastisol.

The top layer 15 of the PVC plastisol extends over the entire surface of the decorative laminate so as to overlie the printed absorptive PVC resin particles 14. Any method of coating is satisfactory. For example, use of a rotary screen applicator that is equipped with a blade squeegee device has permitted achievement of a thin, uniform PVC plastisol coating on the layer of absorptive PVC resin particles.

Fusing The Laminate Structure

Following application of the top layer 15 of resinous plastisol composition, the intermediate decorative laminate is heated by conventional means, e.g., in a convection oven or by radiant energy, at an elevated temperature to expand the foamable layers and to fuse the entire product and provide a product of unitary construction. Suitable temperatures for heating the intermediate laminate include a range of between about 350° F. and about 500° F., preferably 400° F.

As shown in FIGS. 1, 2 and 3, the resulting fused, decorative laminate is characterized by unique features comprising a thin, printed (through-color) layer of absorptive PVC resin particles having a thickness corresponding substantially to the particle size of the absorptive PVC resin particle, namely, 6–10 mils thick. Surprisingly, the thin layer of absorptive PVC resin particles enables multiple applications of vinyl plastisol printing inks, and suitable results have been achieved utilizing four differently colored vinyl plastisol printing inks. For example, decorative vinyl flooring products having many different visual effects can be obtained by combining the foregoing techniques. For instance, a vinyl flooring product which embodies the characteristic features of ceramic type floors can be obtained by printing the layer of absorptive PVC resin particles with three differently colored vinyl plastisol printing inks in a selected pattern to represent randomly positioned aggregates of gray and white color tones separated by a grouting of yet a third color such as brown or black. Also, the use of a combination of foamable and nonfoamable vinyl plastisol printing inks can provide desirable visual effects and flooring products having a differential profile. For example, a nonfoamable vinyl plastisol printing ink can be applied to regions of the layer of absorptive PVC resin particles as would represent the grout lines of a floor of ceramic tile material, and a foamable vinyl plastisol printing ink can be applied to adjacent regions representing the ceramic tile elements. In this instance, the entire intermediate laminate is heated to foam or expand the foamable layer of vinyl plastisol printing ink thereby to achieve a decorative floor covering having a differential profile, i.e., an embossed surface, wherein the recessed portions representative of grout lines are at a lower level than adjacent raised regions that are representative of the ceramic floor tile element.

The present invention is illustrated and described further in the following Examples which are merely exemplary and which show typical preferred embodiments thereof. All parts and percentages in the following Examples are by weight, unless otherwise specified.

EXAMPLE 1

Figure 1B:
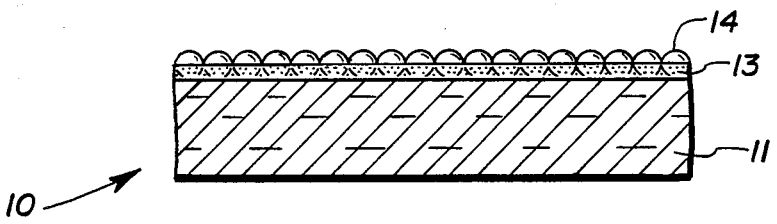

This example illustrates the decorative laminate of FIG. 1B. Onto a smooth, nonasbestos felt backing member having a thickness of about 0.020 inch was applied 2 to 4 mils of a colored, pigmented vinyl plastisol adhesive composition (base layer) of the following composition:

| | phr |
|---|---|
| Vinyl chloride dispersion resin (Tenneco 1732) | 100 |
| Primary plasticizer (DOP) | 35 |
| Secondary plasticizer (TXIB) | 17 |
| Epoxy stabilizier (Drapex 4.4) | 3 |
| Tin stabilizer (Mark 275) | 1 |

The wet plastisol adhesive base layer was flooded with large particle size, absorptive PVC resin (Geon 92) and the excess particles removed by blowing air across the sheet. The resultant composite having a single particle thick layer of Geon 92 resin particles was subsequently gelled at 300° F. in a hot air oven. Two standard plastisol inks—one clear/transparent and one pigmented-/opaque—of the following composition:

| | phr |
|---|---|
| Vinyl chloride dispersion resin (Occidental 605) | 100 |
| Primary plasticizer (Santicizer S-711) | 34.8 |
| Secondary plasticizer (TXIB) | 5.0 |
| Epoxy stabilizer (Drapex 4.4) | 2.0 |
| Zinc Octoate (ABC-18) | 1.0 |
| ABFA blowing agent (Kempore Af) | 1.6 |
| Pigment (if utilized) | 0.5 to 2.0 |

were printed in a registered pattern into the single particle thick layer of Geon 92 resin particles using rotary screen/roller squeegee techniques. The printed composite was then fused in a hot air oven at 400° F. to produce a 32 to 34 mil flooring product having a ten mil through-color printed wear surface. The color of the pigmented base layer was observable through the clear-/unpigmented printed regions of the 10 mil through-color layer.

EXAMPLE 2

Figure 2B:
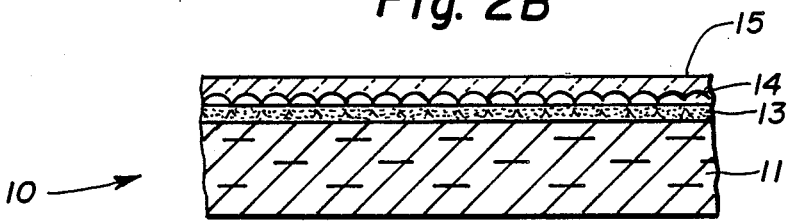

This example illustrates the decorative laminate of FIG. 2B. The printed composite of Example 1 was gelled at 300° F. in a hot-air convection oven and thereafter clear coated with 10 mils of a vinyl plastisol wear layer formulation having the following composition:

| | phr |
|---|---|
| PVC dispersion resin (Goodrich Geon 173) | 96 |
| PVC blending resin (Borden 260SS) | 4 |
| Primary plasticizer (DOP) | 25 |
| Secondary plasticizer (TXIB) | 17 |
| Epoxy stabilizer (Drapex 4.4) | 3 |
| Tin stabilizer | 1 |

After fusing at 400° F. in a hot air oven the product was mechanically embossed, producing a 42 to 44 mil flooring product having a 10 mil through-color top or wear layer.

EXAMPLE 3

This example illustrates the decorative laminate of FIG. 3. Onto the nonasbestos carrier of Example 1 was applied 8 mils of a rotogravure foamable plastisol layer having the following composition:

| | phr |
|---|---|
| Vinyl chloride dispersion resin (Occidental 605) | 72 |
| Vinyl chloride blending resin (Goodyear Pliovic M-70) | 28 |
| Primary plasticizer (DOP) | 45 |
| Epoxy stabilizer (Drapex 4.4) | 1.0 |
| Zinc octoate (ABC-18) | 1.4 |
| ABFA Blowing agent (Kempore Af) | 2.5 |

via reverse roll coating and subsequently gelled at 300° F. Then, 2 to 4 mil, pigmented, plastisol adhesive composition (base layer) and the Geon 92 particles were applied and gelled as in Example 1. Using rotary screen/roller squeegee techniques the single particle layer was printed with three inks in a pattern design as follows utilizing the wet-on-wet printing procedure: ink #1 was clear, unpigmented; ink #2 was pigmented, opaque; and ink #3 was a pigmented, foamable plastisol composition. After printing, the composite was gelled, 10 mils of a plastisol wear layer applied and the product was fused at 400° F. and expanded. The resulting product consisted of raised, foamed regions, and recessed regions exhibiting the color of the opaque plastisol ink or color of the base layer (clear plastisol ink regions) covered with 10 mil wear surface.

EXAMPLE 4

The procedure of Example 3 was repeated except that the initial 8 mil rotogravure foamable plastisol was pigmented, and the particles of Geon 92 were applied directly to this layer (the 2 to 4 mil pigmented plastisol base composition was eliminated). The resultant product was identical to that described in Example 3.

EXAMPLE 5

This example illustrates the decorative laminate of FIG. 2A. Onto a nonasbestos felt carrier was applied 8 mils of a rotogravure foamable plastisol layer (of the composition disclosed in Example 3) via a reverse roll coater and subsequently gelled at 300° F. The resultant composite was then rotogravure printed (marble pattern) using standard rotogravure inks and printing methods. Onto this substrate, 2 mils of clear/transparent/unpigmented plastisol adhesive (of the composition disclosed in Example 1) was applied and the surface flooded with Geon 92 vinyl particles, and the excess particles were removed and the layer gelled at 300° F. as in Example 1. A stone pattern was printed into the single particle layer of Geon 92 by using two rotary screens (equipped with roller squeegees). The mortar areas were printed with a standard, pigmented, opaque plastisol ink, while the stone area was printed with a clear, transparent, unpigmented plastisol ink of the composition disclosed in Example 1. After gelling (at 300° F.) the printed composite was clear coated with the composition disclosed in Example 2 and fused at 400° F. (foamable plastisol layer expanded to 30 mils) as in Example 2. The resultant 70 mil product had marbleized stone regions with opaque, 10 mil through-color grout surrounds.

EXAMPLE 6

This example illustrates the decorative laminate of FIG. 3. Onto a nonasbestos felt carrier was applied 8 mils of a rotogravure foamable plastisol of the composition of Example 3 via reverse roll coating and subsequently gelled at 300° F. The surface of the foamable plastisol was printed using standard rotogravure inks by applying a 2 mil clear vinyl plastisol adhesive layer (of the composition of Example 1) and the surface flooded with Geon 92 PVC particles and the excess removed as in Example 1. After gelling, the composite was printed in register with the rotogravure design using the three inks as described in Example 3. After printing the structure was gelled at 300° F., clear coated with ten mil plastisol wear surface (of the composition of Example 2) and fused and expanded (at 400° F.) as in Example 3. The resultant product consisted of: (1) raised, opaque foamed regions, (2) recessed, opaque 10 mil through-color regions, and (3) clear regions, in register with the printed rotogravure design.

What is claimed is:

1. A method for making a decorative laminate suitable as a floor covering, said method comprising:

applying to a substrate material a vinyl plastisol composition;

applying an excess of absorptive PVC resin particles of type GP PVC resin having a particle size diameter between about 6 mils and about 20 mils, a cell classification number of 4 and a plasticizer absorption greater than about 40 grams per 100 grams of PVC resin over said vinyl plastisol composition and the surface of said substrate and removing the excess of said absorptive PVC resin particles that do not adhere to said vinyl plastisol composition; heating said substrate to gel said vinyl plastisol composition thereon and thereby firmly adhere said absorptive PVC resin particles thereto;

applying at least one PVC plastisol printing ink composition to said absorptive PVC resin particles, and heating said substrate to gel said PVC plastisol printing ink composition and provide a layer of printed, absorptive PVC resin particles; and forming a top resinous layer on said layer of printed absorptive PVC resin particles by applying a transparent synthetic organic polymer over said printed, absorptive PVC resin particles, followed by heating the resulting intermediate laminate of resinous layers thereby to provide a fused decorative laminate, whereby the printed regions of said decorative laminate exhibit through-color printing.

2. The method of claim 1 wherein said transparent synthetic organic polymer of said top resinous layer is polyvinyl chloride.

3. The method of claim 1 wherein said substrate comprises a flexible base member and a layer of a foamed polyvinyl chloride resin bonded to at least one surface of said flexible base member.

4. The method of claim 3 wherein said flexible base member is a resin-impregnated web of felted fibers.

5. The method of claim 4 wherein said transparent synthetic organic polymer of said top resinous layer is polyvinyl chloride.

6. A method for making a decorative laminate suitable as a floor covering, said method comprising:

forming a gelled, foamable, resinous vinyl layer on a substrate material by applying a foamable vinyl plastisol onto said substrate and heating said resinous layer thereby to provide said gelled, foamable, resinous layer;

applying to said gelled, foamable, resinous vinyl layer a vinyl plastisol adhesive composition;

applying an excess of absorptive PVC resin particles of type GP PVC resin having a particle size diameter between about 6 mils and about 20 mils, a cell classification number of 4 and a plasticizer absorption greater than about 40 grams per 100 grams of PVC resin over said vinyl plastisol adhesive composition and removing the excess of said absorptive PVC resin particles that do not adhere to said vinyl plastisol adhesive composition;

heating said substrate to gel said vinyl plastisol adhesive composition and thereby firmly adhere said absorptive PVC resin particles to said vinyl plastisol adhesive composition;

applying at least one PVC plastisol printing ink composition to said absorptive PVC resin particles, and heating said substrate to gel said PVC plastisol printing ink composition and provide a layer of printed, absorptive PVC resin particles;

forming a top resinous layer on said printed, absorptive PVC resin particles by applying a transparent synthetic organic polymer over said printed, absorptive PVC resin particles; and heating the resulting intermediate laminate of resinous layers thereby to provide a fused decorative laminate, whereby the printed regions of said decorative laminate exhibit through-color printing.

7. The method of claim 6 wherein said top resinous layer is polyvinyl chloride.

8. The method of claim 7 wherein said substrate comprises a resin-impregnated flexible web of felted fibers.

9. The method of claim 6 wherein three differently colored PVC plastisol printing ink compositions are applied to said absorptive PVC resin particles.

10. The method of claim 9 wherein said top resinous layer is polyvinyl chloride.

* * * * *